US006877201B2

(12) United States Patent
Gunshinan et al.

(10) Patent No.: US 6,877,201 B2
(45) Date of Patent: Apr. 12, 2005

(54) GOLF CLUB GRIP ALIGNMENT APPARATUS AND METHOD

(75) Inventors: Frank Gunshinan, Surprise, AZ (US); Kendall Horstman, Peoria, AZ (US)

(73) Assignee: Karsten Manufacturing Corp., Phoenix, AZ (US)

( * ) Notice: Subject to any disclaimer, the term of this patent is extended or adjusted under 35 U.S.C. 154(b) by 61 days.

(21) Appl. No.: 10/613,978

(22) Filed: Jul. 2, 2003

(65) Prior Publication Data

US 2005/0000075 A1 Jan. 6, 2005

(51) Int. Cl.[7] ..... G01M 19/00; B23P 21/00

(52) U.S. Cl. ..... 29/407.01; 29/407.09; 29/407.1; 29/271; 29/281.1; 29/712; 29/714; 33/508; 33/645

(58) Field of Search ..... 29/407.01, 407.04, 29/407.09, 407.1, 426.5, 271, 281.1, 712, 714, 721; 33/533, 645, 666; 269/300

(56) References Cited

U.S. PATENT DOCUMENTS 5,771,552 A * 6/1998 Karner et al. ..... 29/407.1
5,870,815 A 2/1999 Karner et al.
6,006,805 A * 12/1999 Karner et al. ..... 156/379
6,245,178 B1 * 6/2001 Lenhof et al. ..... 156/187
6,279,637 B2 * 8/2001 Lenhof et al. ..... 156/423
6,415,502 B1 7/2002 Gunshinan et al.
6,543,125 B2 * 4/2003 Weiss et al. ..... 29/720
6,550,121 B2 * 4/2003 Weiss et al. ..... 29/407.07
6,572,488 B1 * 6/2003 Weiss et al. ..... 473/289
6,609,429 B2 * 8/2003 Weiss et al. ..... 73/854
6,629,354 B1 * 10/2003 Kline ..... 29/559

* cited by examiner

*Primary Examiner*—Essama Omgba
(74) *Attorney, Agent, or Firm*—Darrell M. Marquette

(57) ABSTRACT

An apparatus for positioning and holding a golf club for installation of a golf club grip comprises a shaft cradle, a shaft clamp and a positioning device. The positioning device comprises a platen that is moveable toward and away from the axis of the golf club shaft when the golf club shaft is positioned in the apparatus. Mounted to the platen are a fixed stop and an opposing moveable ram. The fixed stop has a stop surface that is adapted to engage the face of the club so that as the opposing moveable ram presses the golf club head against the fixed stop, the face will assume an orientation flush against the surface of the fixed stop, thus aligning the club face with the stop surface. The entire platen assembly is moveable toward and away from the axis of the golf club shaft so as to accommodate golf clubs having different offsets. The shaft clamp holds the golf club in position once the club face is aligned and an indicator device provides a visual alignment reference for aligning the grips during installation.

13 Claims, 4 Drawing Sheets

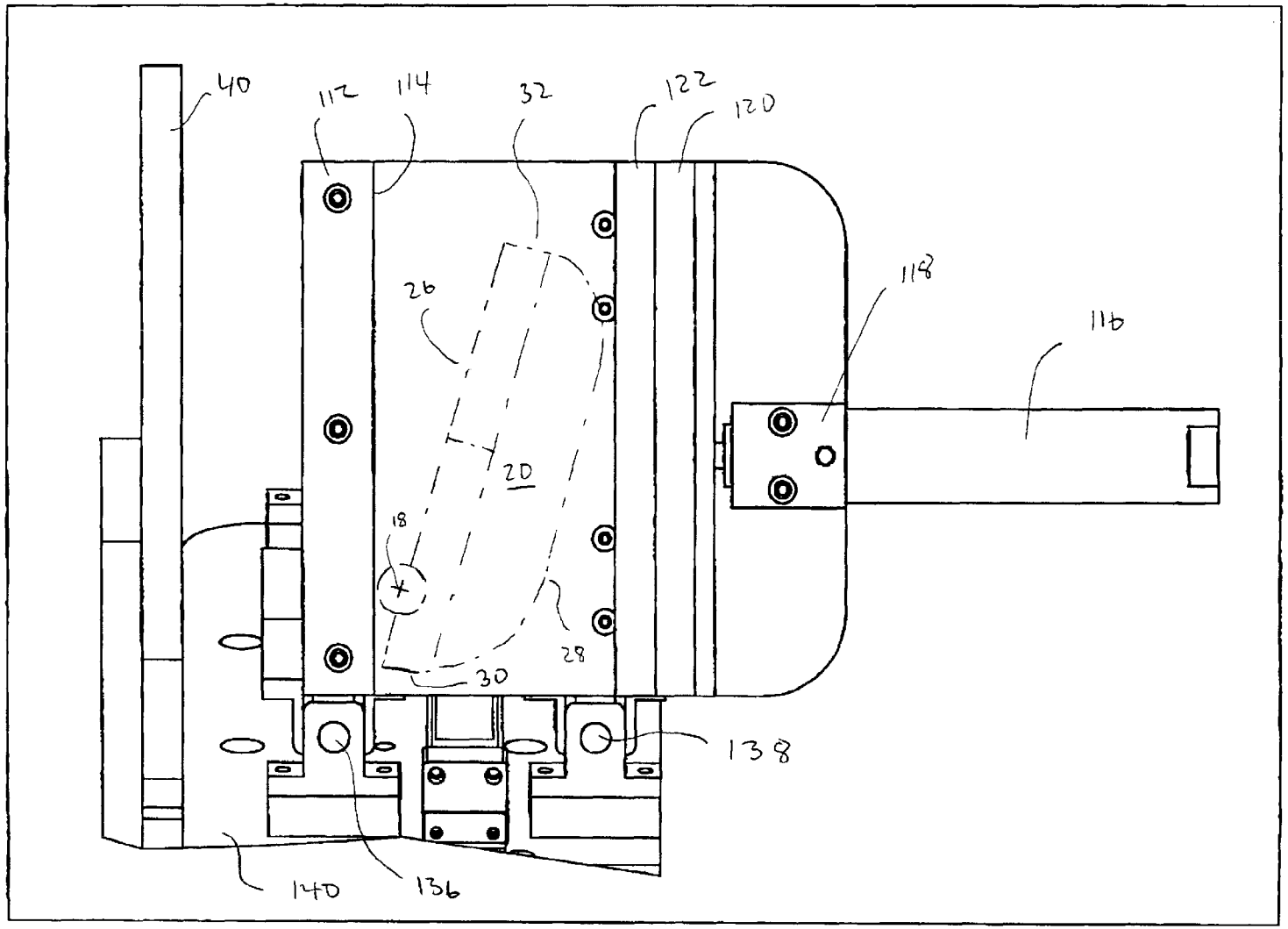
40
41
42
43
44
45
46
47
48
49
50
51
52
53
54
55
56
57
58
59
60
61
62
63
64
65
66
67
68
69
70
71
72
73
74
75
76
77
78
79
80

GOLF CLUB GRIP ALIGNMENT APPARATUS AND METHOD

BACKGROUND OF THE INVENTION

This invention relates in general to golf clubs and, more particularly, to an apparatus for positioning and holding a golf club for installation of a golf club grip.

The vast majority of golf club grips are not perfectly axi-symmetrical. Typically, golf club grips include a ridge or a flat designed to assist the golfer in lining up the club in preparation for hitting a golf ball. Because the golf club grip is not perfectly axi-symmetrical it must be installed on the golf club shaft in a particular orientation with respect to the face of the golf club head. To assist the grip installer in aligning the grips, many grips are provided with small alignment marks on the side of the grip facing upward when the club is held horizontally with the face of the club aligned vertically. This allows the installer to visually align the alignment marks with the leading edge of the golf club face while installing the grip. Unfortunately, since the alignment marks and the face of the club are quite a distance apart, mis-aligned grip installation can and often does occur. Recognizing the limitations of visually aligning the leading edge of the golf club face with the grip alignment marks, golf club manufacturers have proposed the use of various apparatus to assist in the grip installation process. U.S. Pat. No. 5,870,815 to Karner, et al. discloses one such alignment apparatus. The alignment apparatus disclosed in Karner, et al. includes a spaced apart vertically aligned pair of rails that provide a vertical datum. When installing a grip, the operator of the mechanism places the club in the mechanism and rotates it about its shaft axis to bring the leading edge of the club head into engagement with the vertical plane defined by the pair of rails. Once aligned in this manner, the operator actuates a clamp that holds the club. A laser beam is used to provide an alignment indicia to guide the operator in the installation of the grip. Because golf clubs have different offsets, as will be hereinafter described in detail, the device on which the pair of rails is mounted translates toward and away from the golf club shaft axis automatically when contacted by the leading edge of the club head. Such translational movement will occur during rotation of the golf club prior to the leading edge of the head coming into contact with both of the rails and can continue if the club is rotated beyond vertical. Therefore, the positioning capability relies solely on the skill and attentiveness of the operator. What is needed then is a golf club installation apparatus that automatically clamps the golf club with the leading edge of the face oriented for installation of a golf club grip.

SUMMARY OF THE INVENTION

An apparatus for positioning and holding a golf club for installation of a golf club grip in accordance with the present invention comprises a positioning device adapted to receive a golf club head and automatically grip the golf club head so that the leading edge of the face is oriented in a predetermined angular position relative to the shaft axis. In one embodiment of the invention, the positioning device comprises a platen that is moveable toward and away from the axis of the golf club shaft. Mounted to the platen are a fixed stop and an opposing moveable ram. The fixed stop has a stop surface that is adapted to engage the face of the club so that as the opposing moveable ram presses the golf club head against the fixed stop, the face lies flush against the surface of the fixed stop, thus aligning the club face with the stop surface. The entire platen assembly is moveable toward and away from the axis of the golf club shaft so as to accommodate golf clubs having different offsets.

The apparatus also includes a shaft cradle for holding the golf club shaft so that it freely rotates about its axis as the positioning device begins to grip the golf club head; and a shaft clamp that automatically clamps the golf club shaft once the face of the golf club head is held against the fixed stop. The illustrative embodiment also includes an alignment indicator mounted to an arm that automatically registers against the shaft axis to provide a visual indication of the proper alignment position of the grip.

In operation, the grip installer places the golf club so that the golf club shaft is supported by the shaft cradle and the sole of the golf club head abuts the platen. The installer then activates the apparatus, which causes the moveable ram to extend to press the face of the golf club against the fixed stop. Once the club is aligned with the face flush against the fixed stop, the shaft clamp is engaged to firmly clamp the golf club shaft for installation of the grip. Subsequently, the arm is lowered until a V-notch in the lower extension of the arm engages the golf club shaft to center the arm over the shaft. Once the arm is centered over the shaft, a visual indicator such as a scanning light beam or laser is engaged, which provides a visual indication along the surface of the golf club shaft coplanar with the longitudinal axis of the shaft as a reference for aligning the golf club grip during installation.

BRIEF DESCRIPTION OF THE DRAWING

The present invention will be better understood from a reading of the following detailed description, taken in conjunction with the accompanying drawing figures in which like references designate like elements, and in which:

FIG. 4 an enlarged fragmentary view taken along the line 4—4 of FIG. 2.

DETAILED DESCRIPTION

Figure 1:
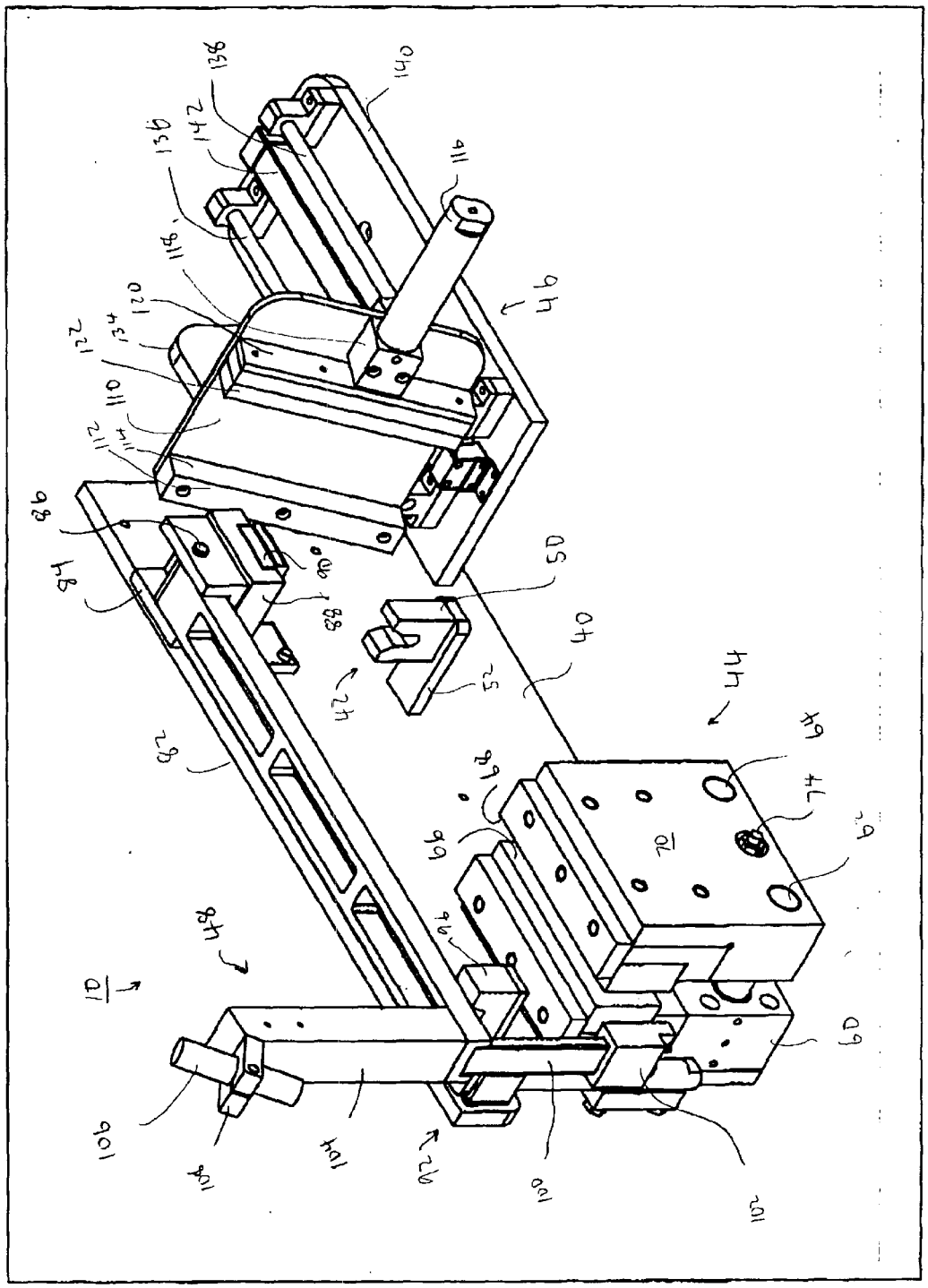
FIG. 1 is an isometric view of an illustrative embodiment of an apparatus incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and the detailed description are not intended to limit the invention to the particular form disclosed, but are merely illustrative and intended to teach one of ordinary skill how to make, and/or use the invention claimed herein and for setting forth the best mode for carrying out the invention.

Figure 2:
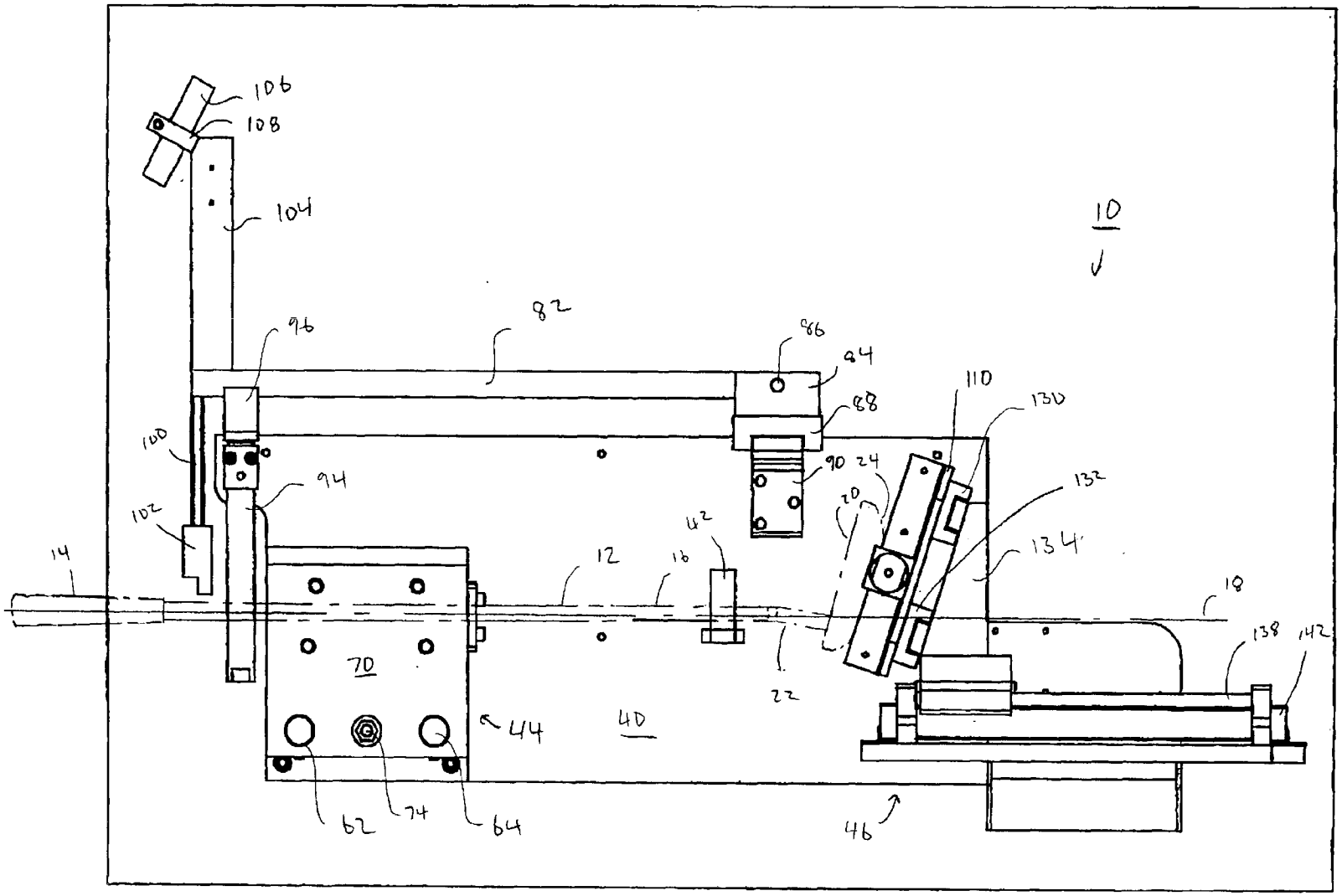
FIG. 2 is a side elevational view of the apparatus shown in FIG. 1.
Figure 3:
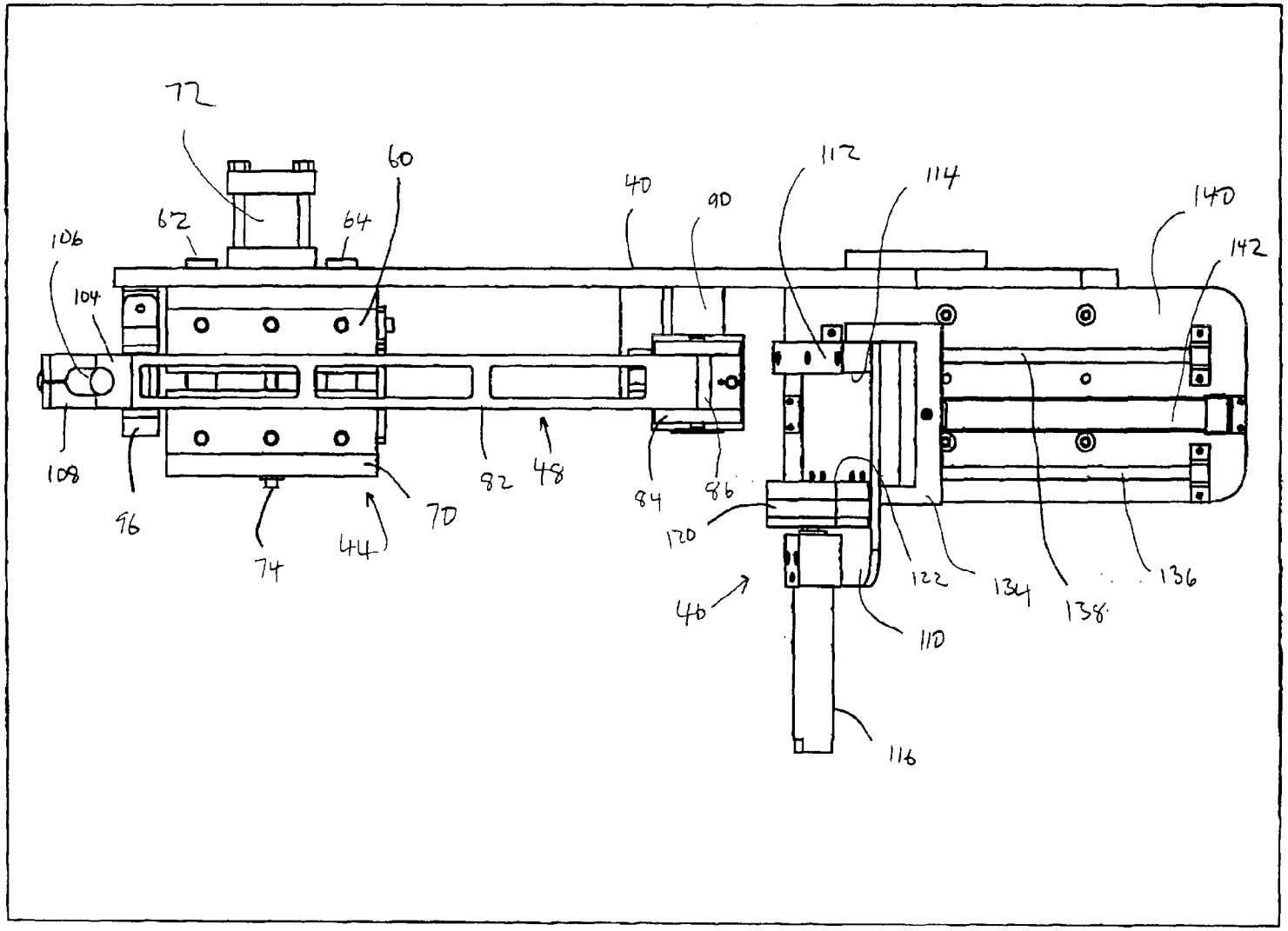
FIG. 3 is a top elevational view of the apparatus shown in FIG. 1.

With reference to the drawing figures, and in particular FIGS. 1, 2 and 4, an apparatus 10 is adapted for positioning and holding a golf club 12 (shown in phantom lines in FIGS. 2 and 4) for installation of a golf club grip 14. The golf club 12 comprises a golf club shaft 16 defining a longitudinal axis 18. A golf club head 20 is attached to the golf club shaft 16 at the end opposite golf club grip 14. The golf club head 20 is provided with a hosel 22 by which the club head is affixed to the shaft 16. With reference in particular to FIGS. 2 and 4, the club head 20 has a sole portion 24, a face portion 26 adapted to strike a golf ball, a rear portion 28, a heel portion 30 and a toe portion 32. The angle formed between the sole portion 24 and the longitudinal axis 18 is generally referred to as the "lie" angle of the club. The club face is generally inclined at an angle relative to the shaft axis which is known as the "loft" angle. Many golf clubs are also manufactured with what is commonly referred to as an offset. An offset may be defined as the relationship between the shaft axis and the center of the golf club face. If the shaft axis intersects a horizontal line in the plane of the face passing through the center of the face when the club is in position for striking a golf ball (hereinafter defined as the horizontal face axis), there is no offset. If the shaft axis does not intersect the horizontal face axis, then there is offset.

With reference in particular to FIG. 1, apparatus 10 comprises a frame 40 supporting a shaft cradle 42, a shaft clamp 44, a positioning device 46 and an indicator assembly 48.

Shaft cradle 42 comprises a bracket 50 made of a polymer such as ultra high molecular weight polyethylene (UHMWP) or other material that will not mar the surface of the golf club shaft yet has high abrasion resistance. Bracket 50 is supported in the proper orientation for holding golf club shaft 16 by means of a stand-off 52 attached to frame 40.

Shaft clamp 44 comprises a fixed jaw 60 that is mounted on frame 40 and a pair of shafts 62 and 64 attached to fixed jaw 60 that extend normally to the clamping surface 66 of fixed jaw 60. A moveable jaw 70 is slidably carried on the shafts 62 and 64 for movement between a closed position and an open position. A pneumatic cylinder 72 is mounted on the back surface of frame 40 and extends through suitable holes provided in frame 40 and fixed jaw 60 to engage moveable jaw 70. Pneumatic cylinder 72 has an actuator 74 with suitable means of attachment for attaching it to moveable jaw 70, such as a threaded end that engages mating threads tapped in moveable jaw 70. Clamping surfaces 66 and 68 of fixed jaw 60 and moveable jaw 70, respectively are composed of a suitable material such as UHMWP or other polymer that will grip the golf club shaft 16 without marring the finish.

Indicator assembly 48 includes an elongated alignment bar 82 with one end thereof mounted in a clevis 84 by means of a pivot pin 86. The clevis 84 is carried on a linear ball-bearing slide 88 that has its base 90 attached to frame 40. Linear ball-bearing 88 permits the entire indicator assembly 48 to move transverse to the longitudinal axis 18 of a golf club shaft 16 clamped in shaft clamp 44 and resting in cradle 42. The linear ball-bearing slide 88 used in the illustrative embodiment is identified as part number 6203K13 and is available from McMaster-Carr Supply Company of Santa Fray Springs, Calif.

A plate 100 depends downward from the free end 92 of alignment bar 82 and terminates in a registration device 102 which preferably is a V-block. When indicator assembly 48 is moved into an operating position as will hereinafter be described, the downwardly facing V-shaped opening of the V-block 102 will come to rest in a straddling position on the golf club shaft 16. The lateral movement capability of the indicator assembly 48 provided by the linear ball-bearing slide 88 allows for golf clubs having different shaft dimensions to be gripped in the apparatus 10 while at the same time ensuring that indicator assembly 48 will at all times be centered over golf club shaft 16. When V-block 102 is placed in a straddling position on the golf club shaft 16, the alignment bar 82 will be laterally moved as necessary to provide registered vertical alignment between the indicator and the golf club shaft 16.

A bracket 104 depends upwardly from the free end 92 of alignment bar 82. A visual indicator 106 is attached to bracket 104 by means of a clamp 108 or other suitable mounting means. Visual indicator 106 preferably comprises a light source such as a halogen beam, laser, or other focused light capable of producing a visually perceptible line along the longitudinal axis 18 of a golf club shaft 16 clamped in shaft clamp 44. Alternatively, visual indicator 106 may comprise an extensible pointer such as disclosed in U.S. Pat. No. 6,415,502 the contents of which are incorporated herein by reference. A pneumatic cylinder 94 is attached to frame 40 proximal the free end 92 of indicator assembly 48. The actuator of pneumatic cylinder 94 is attached to a cradle 96 that lifts alignment bar 82 up and out of the way to facilitate placing of a golf club in apparatus 10. Pneumatic cylinder 94 is de-energized to allow V-block 102 to rest on a golf club shaft to register indicator assembly 48 as herein before described.

Positioning device 46 comprises a platen 110 to which is mounted by screws or other conventional means a fixed stop 112 which has a stop surface 114. Stop surface 114 is disposed generally vertically when viewed along longitudinal axis 18, although stop surface 114 may be undercut to a 3° angle or other angle as required to match the loft of the club being placed in apparatus 10. In the illustrative embodiment, fixed stop 112 is made from UHMWP, however, any suitable rigid material that will not mar the finish of the golf club yet has high resistance to abrasion would be suitable.

A pneumatic cylinder 116 is also attached to platen 110 by means of a suitable mounting block 118. The actuator of pneumatic cylinder 116 operates a moveable ram 120 that is moveable toward and away from fixed stop 112 across the surface of platen 110. The clamping surface 122 of moveable ram 120 is made of a soft material that will conform somewhat to the shape of the rear surface 28 of a golf club head 20 clamped between the moveable ram 120 and fixed stop 112. With particular reference to FIG. 2, platen 110 is mounted on a pair of linear roller bearings 130 and 132 mounted to a base bracket 134. Linear roller bearings 130 and 132 permit platen 110 to move transversely with respect to longitudinal axis 18 of golf club shaft 16 for reasons that will hereinafter become apparent. Base bracket 134, in turn, slidingly engages a pair of rails 136 and 138 mounted to a platform 140 which, in turn, is mounted to frame 40. A double acting pneumatic cylinder 142 is disposed between platform 140 and base bracket 134 to move base bracket horizontally along rails 136 and 138 toward and away from shaft cradle 42 to permit apparatus 10 to be adjusted for clubs having different shaft lengths and/or different hosel lengths.

With particular reference to FIGS. 2 and 4, in operation, with indicator assembly 48 lifted out of the way by pneumatic cylinder 94, the operator places golf club shaft 16 in shaft cradle 42 with the sole portion 24 of golf club head 20 abutting the surface of platen 10. Because longitudinal axis 18 of golf club shaft 16 is slightly inclined, gravity holds sole portion 24 of golf club head 20 against the surface of platen 110. As shown in FIG. 4, gravity acting on golf club head 20 will also tend to cause toe portion 32 to fall away from stop surface 114 of fixed stop 112. Upon actuation of pneumatic cylinder 116, moveable ram 120 will cause clamping surface 122 to engage the rear portion 28 of club head 20 and rotate club head 20 toward stop surface 114. Simultaneously, the reaction from the force of moveable ram

120 acting against club head 20 causes platen 110 to move along linear roller bearings 130 and 132 to bring stop surface 114 into engagement with face 26 of club head 20 with face 26 ultimately coming to rest flush with stop surface 114 of fixed stop 112. Thus, face 26 of club head 20 is aligned vertically irrespective of the overall shape of club head 20. Once face 26 is brought into contact with stop surface 114, as determined by cessation of movement of moveable ram 120, cessation of movement of platen 110, or merely elapsed time, shaft clamp 44 is actuated to clamp golf club shaft 16 proximal the end where the grip 14 is to be installed. Immediately after shaft clamp 44 is closed, pneumatic cylinder 94 is deactivated allowing indicator assembly 48 to come to rest with the block 102 registering on golf club shaft 16. Once indicator assembly 48 comes to rest, visual indicator 106 is illuminated to provide a reference along the surface of golf club shaft 16 coplanar with longitudinal axis 18. The visual indication thus provided permits the installer to install the grip using installation techniques well-known in the art while aligning the grip by referencing the visual indication provided by visual indicator 106. When the installation is complete, the operator depresses a switch, which activates pneumatic cylinder 94 to lift indicator assembly 48 out of the way and thereafter unclamp shaft clamp 44 to permit the golf club 12 to be removed from the apparatus 10 and a subsequent club to be placed in the apparatus to repeat the process.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. An apparatus for positioning and holding a golf club for installation of a golf club grip, the golf club comprising a golf club head attached to a golf club shaft, the golf club shaft having a longitudinal axis and the golf club head comprising a sole, a face portion and a rear portion, said apparatus comprising:

a frame, said frame having a first end and a second end;

a shaft cradle attached to said frame, said shaft cradle comprising a bracket having a surface adapted to receive the golf club shaft with the longitudinal axis of the golf club shaft oriented along a first axis;

a shaft clamp attached to said frame proximal said first end of said frame, said shaft clamp being capable of moving from an open position in which the golf club shaft is freely rotatable about the longitudinal axis to a closed position in which the golf club shaft is held stationary with respect to said frame;

an actuator for moving said shaft clamp between said open position to said closed position; and a positioning device mounted to said frame proximal said second end of said frame, said positioning device comprising a platen adapted to abut the sole of the golf club head when the golf club is received in said apparatus, said platen being moveable along a second axis lying in a plane normal to the first axis, said positioning device further comprising a fixed stop mounted to said platen and an opposing moveable ram also mounted to said platen, said fixed stop having a stop surface adapted to engage and hold the face portion of the golf club head in a predetermined angular orientation relative to the first axis, said ram being moveable into and out of engagement with the golf club head to rotate the golf club about the longitudinal axis of the shaft until said face portion abuts said stop surface; and an actuator for moving said ram into and out of engagement with the golf club head when the golf club head is received in the apparatus.

2. The apparatus of claim 1, further comprising:

an indicator mounted to the frame proximal the first end of said frame for providing visual alignment between the face portion of the golf club head abutting said stop surface and the golf club shaft at a location distal of the golf club head.

3. The apparatus of claim 2, further comprising:

an arm, said arm having a free end supporting said indicator and a fixed end that is pivotally mounted on an axis perpendicular to the longitudinal axis of the golf club shaft.

4. The apparatus of claim 3, wherein:

said indicator comprises a light beam.

5. The apparatus of claim 1, wherein:

said shaft clamp comprises a pair of opposed jaws in which one jaw is moveable toward and away from the other jaw for clamping the golf club shaft.

6. The apparatus of claim 1, wherein:

said shaft cradle comprises a block having an upper surface and a lower surface, said block having a slot formed therein having a bottom surface that is concave upward.

7. The apparatus of claim 6, wherein:

said fixed stop is made from an ultra high molecular weight polyethylene.

8. The apparatus of claim 1, wherein:

said fixed stop and said moveable ram are made of different materials.

9. A method for positioning and holding a golf club shaft for installation of a golf club grip comprising:

selecting a golf club comprising a golf club head attached to a golf club shaft, the golf club shaft having a longitudinal axis, the golf club head comprising a sole, a face portion and a rear portion;

placing the golf club in an apparatus comprising a frame to which are mounted a shaft cradle, a shaft clamp, and a club head positioning device, the golf club being placed in the apparatus such that the golf club shaft rests in the shaft cradle and is freely rotatable about the longitudinal axis of the golf club shaft with the sole abutting the club head positioning device, the club head positioning device comprising a platen carrying a fixed stop proximal the face of the golf when the golf club is placed in the apparatus and a moveable ram proximal the rear portion of the golf club head when the golf club is placed in the apparatus, the platen being moveable along an axis perpendicular to the longitudinal axis of the golf club shaft when the golf club is placed in the apparatus;

energizing the moveable ram to cause the moveable ram to clamp the golf club head with the face of the golf club head abutting the fixed stop; and closing the shaft clamp against the golf club shaft to hold the golf club in a fixed position.

10. The method of claim 9, further comprising:

lowering an arm having a fixed end pivotally attached to the frame of the apparatus and a free end such that said arm rests against the golf club shaft with an indicator device centered over the golf club shaft.

11. The method of claim 10, further comprising:

energizing the indicator device to provide a light beam on the surface of the shaft coplanar with the longitudinal axis of the shaft.

12. The method of claim 11 further comprising:

installing a golf club grip having an indicator mark on the shaft such that the indicator mark is aligned with the light beam.

13. An apparatus for positioning and holding a golf club for installation of a golf club grip, the golf club comprising a golf club head attached to a golf club shaft, the golf club shaft having a longitudinal axis and the golf club head comprising a sole, a face portion and a rear portion, said apparatus comprising:

a frame, said frame having a first end and a second end;

a shaft cradle attached to said frame, said shaft cradle comprising a block having an upper surface and a lower surface, said block having a slot formed therein, said slot having a bottom surface that is concave upward for supporting the golf club shaft with the longitudinal axis of the golf club shaft oriented along a first axis;

a shaft clamp attached to said frame proximal said first end of said frame, said shaft clamp comprising a pair of opposed jaws capable of moving from an open position in which the golf club shaft is freely rotatable about the longitudinal axis to a closed position in which the golf club shaft is held stationary with respect to said frame;

an actuator for moving said shaft clamp between said open position to said closed position; and a positioning device mounted to said frame proximal said second end of said frame, said positioning device comprising a platen adapted to abut the sole of the golf club head when the golf club is received in said apparatus, said platen being moveable along a second axis lying in a plane normal to the first axis, said positioning device further comprising a fixed stop mounted to said platen and an opposing moveable ram also mounted to said platen, said fixed stop having a stop surface adapted to engage and hold the face portion of the golf club head in a predetermined angular orientation relative to the first axis, said ram being moveable into and out of engagement with the golf club head to rotate the golf club about the longitudinal axis of the shaft until said face portion abuts said stop surface;

an actuator for moving said ram into and out of engagement with the golf club head when the golf club head is received in the apparatus; and an indicator mounted to the frame proximal the first end of said frame for providing visual alignment between the face portion of the golf club head abutting said stop surface and the golf club shaft at a location distal of the golf club head.

* * * * *